United States Patent [19]

Sink

[11] 4,150,830

[45] Apr. 24, 1979

[54] AIR TUBE GAME APPARATUS

[76] Inventor: Marshall E. Sink, P.O. Box 271, Fairview, Oreg. 97024

[21] Appl. No.: 879,218

[22] Filed: Feb. 21, 1978

[51] Int. Cl.[2] ..... A63F 3/00

[52] U.S. Cl. ..... 273/265; 273/85 H; 273/95 C

[58] Field of Search ..... 273/85 H, 95 C, 119 B, 273/258, 265; 35/9 C, 9 R

[56] References Cited

U.S. PATENT DOCUMENTS

| | | | |
|---|---|---|---|
| 1,629,635 | 5/1927 | Parsons | 35/9 D X |
| 2,190,881 | 2/1940 | Palmer | 35/9 R |
| 2,575,269 | 11/1951 | Hall | 273/265 |
| 3,113,777 | 12/1963 | Senick | 273/265 |
| 3,334,422 | 8/1967 | Little | 273/95 C X |
| 3,452,450 | 7/1969 | Haarmann | 35/9 C |
| 3,752,481 | 8/1973 | Fabricant | 273/258 |

*Primary Examiner*—Harland S. Skogquist

*Attorney, Agent, or Firm*—Kolisch, Hartwell, Dickinson & Stuart

[57] ABSTRACT

Game apparatus for use by opposing players includes a housing having a pair of playing surfaces and first and second arrays of apertures provided on each playing surface. Tubes interconnect the apertures of each first array with apertures of the second array on the other playing surface. The tubes are detachably connected and may be positioned in random orientation.

5 Claims, 5 Drawing Figures

AIR TUBE GAME APPARATUS

BACKGROUND AND SUMMARY

The present invention relates to game apparatus, and more particularly to a novel game apparatus which is played by ejecting game objects from surfaces by means of air impulse.

It is known to construct game apparatus with separate playing surfaces each having a plurality of apertures. The apertures of one surface may be interconnected by means of a channel formed in a playing board to the apertures of the other surface, and game objects received in apertures on either surface may be ejected by a device for producing air impulses. Known air impulse devices may include manually operable squeeze bulbs or bellows. The game objects may take a variety of forms, and the game is played by one opponent injecting air into an aperture which travels through the channel for ejecting an object placed in an aperture on the other playing surface.

Game apparatus as described above may become unchallenging and routine to opposing players because they become aware of which aperture on their playing surface interconnects with an associated aperture on the opposing playing surface. While partitions may be placed between the playing surfaces, it is still possible for opposing players to determine which objects are expelled from placement of the bellows in a corresponding aperture in a playing surface.

Accordingly, it is an object of the present invention to provide a game apparatus for use by opposing players which includes a housing having a pair of playing surfaces, each of the surfaces having a first array of apertures disposed adjacent a second array of apertures. Tubular means detachably interconnect apertures of the first array with apertures of the second array on the other playing surface. Because the tubes are detachably interconnected, they may be selectively changed and thus players will not be aware of which tubes interconnect apertures of the first array with apertures of the second array on the other playing surface.

It is another object of the present invention to provide a game apparatus in which the housing includes playing surfaces positioned for facing in opposite directions thereby eliminating the need for a partition to prevent viewing of opposing playing surfaces by an opposing player.

Still another object of the present invention is to include a rotatable member mounted above each first array of apertures which also includes apertures and which is operable for selectively aligning its apertures with apertures of the first array. Thus, during progression of a game, the rotatable member may be used to selectively position game objects in alignment with different apertures of the first array.

These and additional objects and advantages of the present invention will be more readily understood from a consideration of the drawings and the following detailed description of the preferred embodiment.

DETAILED DESCRIPTION OF THE PREFERRED EMBODIMENTS

Figure 2:
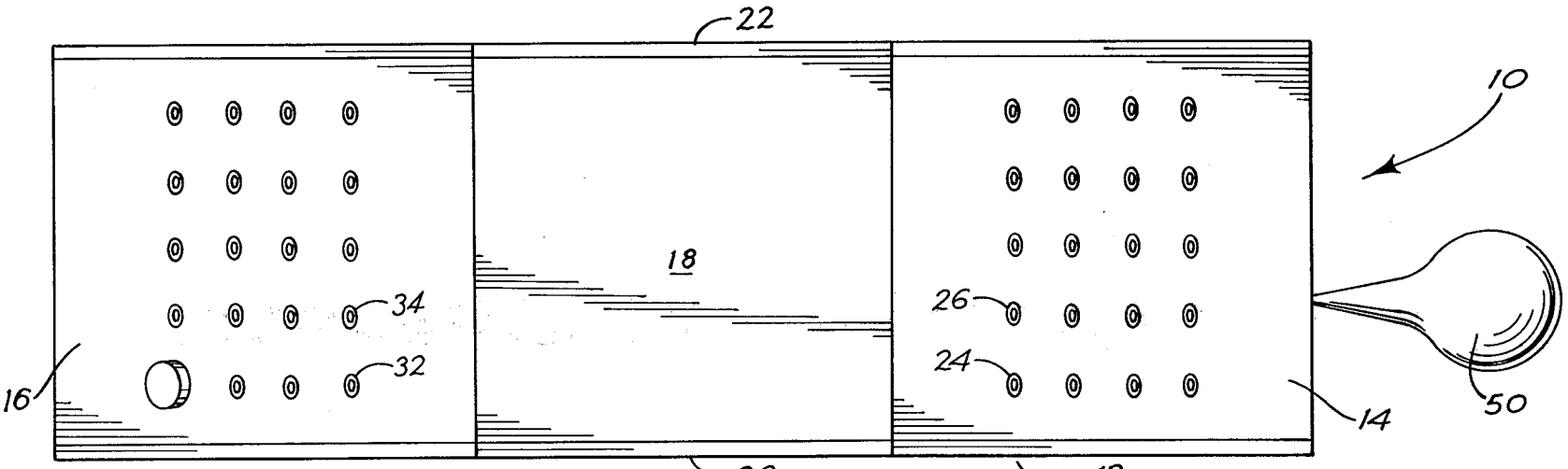
FIG. 2 is a top plan view of the game apparatus of FIG. 1.
Figure 1:
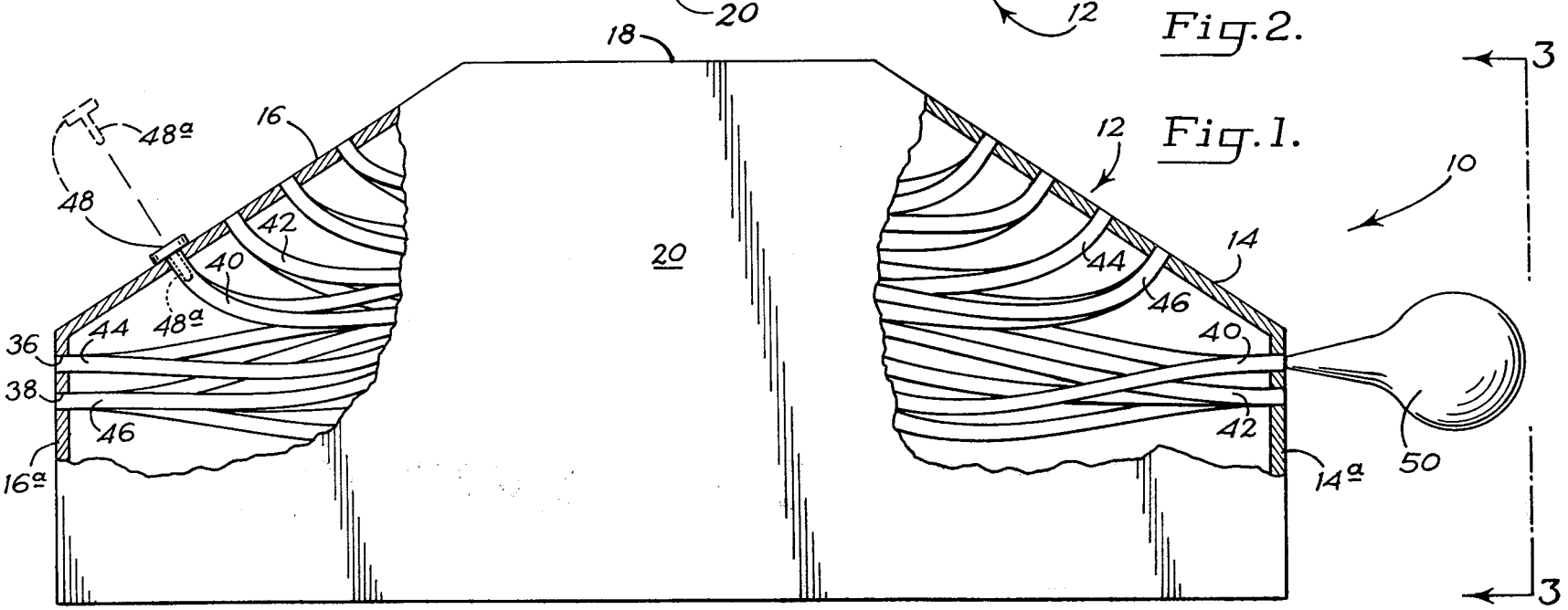
FIG. 1 is a side elevation view, partially broken away, illustrating a first embodiment of a game apparatus according to the principles of the present invention.

Turning now to the drawings, and referring initially to FIGS. 1 and 2, a game apparatus according to the present invention is generally indicated at 10. The game apparatus is constructed with a housing 12 which includes a pair of playing surfaces 14, 16 each of which is positioned for facing a player. As shown in FIG. 1, playing surfaces 14, 16 include lower sections **14*a*, 16*a*, respectively. An upper portion of playing surfaces 14, 16 is interconnected by a top wall 18. A pair of side walls are indicated at 20, 22**, at least one of which is detachably connected by suitable means.

Figure 3:
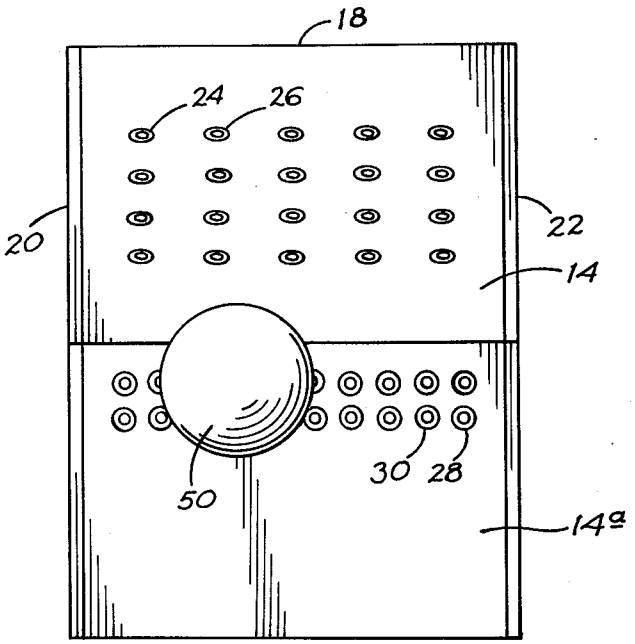
FIG. 3 is an end elevation view taken along lines 3—3 of FIG. 1.

It is to be noted that each playing surface 14, 16 is provided with two groups or arrays of apertures. For instance, playing surface 14 includes a first array of apertures such as apertures 24, 26, etc., which extend through the thickness of the playing surface. Additionally, and with attention also directed to FIG. 3, it can be seen that a second array of apertures such as apertures 28, 30 are provided on section **14*a***.

Similarly, it can be seen that playing surface 16 is provided with a first array of apertures such as apertures 32, 34. Further, section **16*a* is provided with a second array of apertures similar to those shown for section 14*a* in FIG. 3. Two of these apertures are indicated at 36, 38 in FIG. 1**. While it has been illustrated that there are equal numbers of apertures on each of the surfaces, it must be remembered that such a construction would not be absolutely necessary.

According to the present invention, a plurality of tubular means are utilized for detachably interconnecting apertures of the first array on each playing surface with apertures of the second array on the other playing surface. More particularly, it is to be noted that a plurality of flexible tubes such as indicated at 40, 42 extend from apertures on section **14*a* to apertures in playing surface 16. Assuming that there are a like number of apertures on section 14*a* and playing surface 16, each of the apertures on the section may be interconnected with an aperture on playing surface 16. It is to also be noted that flexible tubes such as tubes 44, 46 extending from apertures on section 16*a* are interconnected with apertures on playing surface 14**. The tubes are contemplated as being detachable so that they may be selectively interconnected to a predetermined aperture at either end.

Further, it is to be noted that the interconnection of the tubes form apertures of the first array to apertures of the second array on the other playing surface is done in a random orientation. The reason for the random orientation resides in the fact that the apertures of each playing surface 14, 16 are to receive a playing object having a projection insertable in the aperture. For instance, as shown to the left in FIGS. 1 and 2, a playing object 48 having a projection **48*a* is inserted in an aperture on playing surface 16. While only one object has been shown, it should be understood that the game more than likely would contemplate a plurality of objects each inserted within an aperture on each playing surface 14, 16. Shown to the right in FIGS. 1 and 2 is an air impulse producing means such as a squeeze bulb 50. While only one bulb is shown on the right, it is contemplated that another would be provided for the player on the left. It can be seen that bulb 50 is inserted with its nozzle in an aperture from which a tube leads to an object. An impulse of air produced by bulb 50** through the tube will eject the object.

More particularly, it can be seen that bulb 50 is positioned with its nozzle extending into the aperture which receives tube 40. Tube 40 extends, to the left of FIG. 1, and is received in an aperture in playing surface 16 which holds object 48. Depressing the bulb will force air through tube 40 and expel object 48 as illustrated. As can readily be imagined, challenging and pleasureful games with various rules may be developed around the concept of ejecting objects as described above.

It is to be particularly noted that by providing random orientation of the tubes, and by enabling the tubes to be detachably interconnected, it may be impossible for opposing players (not knowing the orientation) to calculate which aperture is interconnected with an opposite one.

Figure 4:
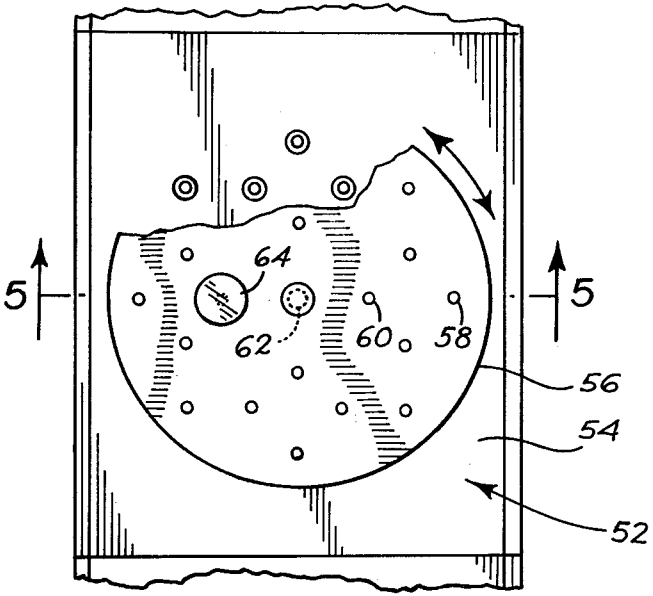
FIG. 4 is an end elevation view of a second embodiment of the present invention incorporating a rotatable member for selectively positioning game objects at preselected positions.
Figure 5:
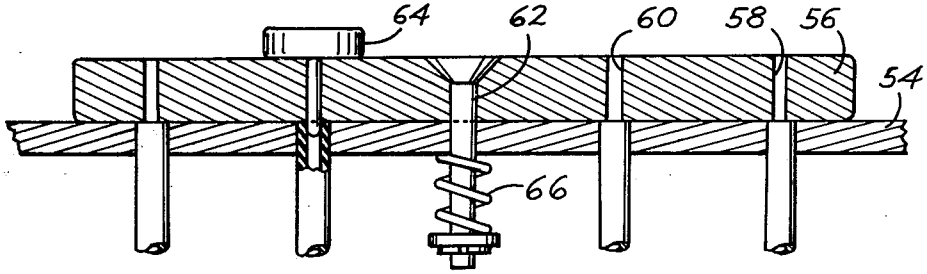
FIG. 5 is a cross-sectional view taken along lines 5—5 of FIG. 4.

Reference is now directed to another embodiment of the present invention illustrated in FIGS. 4 and 5. Basically, as shown in FIG. 4, each playing surface may be provided with a movable means which is mounted above the first array of apertures. More particularly, it can be seen that a movable means, generally indicated at 52, is mounted above playing surface 54. Movable means 52 includes a member 56 rotatably mounted above playing surface 54 and is provided with a plurality of apertures 58, 60 which extend through its thickness. Apertures are also provided on playing surface 54 which would correspond to a first array of apertures. The apertures on rotatable member 56 and playing surface 54 are provided in similar patterns. For instance, as illustrated in FIG. 4, the apertures on playing surface 54 and rotatable member 56 are arranged in similar concentric circular patterns. Member 56 is interconnected by means of a shaft 62 so that it is rotatable relative to the playing surface.

Thus, it can be appreciated that member 56, rotatably mounted on playing surface 54, is operable for selectively aligning its apertures with apertures of the first array on the playing surface. The utility in such a construction resides in the fact that game objects such as indicated at 64 may be received within an aperture in member 56 and aligned in a corresponding aperture in playing surface 54. In order to retain stability of member 56 relative to playing surface 54, it is contemplated that the member will be urged toward the playing surface. For instance, as can be seen in FIG. 5, a biasing means 66 urges rotatable member 56 toward playing surface 54. The game objects such as object 64 are provided with projections which extend into the apertures, and the corresponding tubes, of playing surface 54. Thus, with rotatable member 56 positioned as shown in FIG. 5, the game objects (by means of their projections) will prevent rotation of the rotatable member.

When it is desired to alter the position of the game objects relative to their positioning in the first array of apertures, rotatable member 56 is lifted upwardly so that the ends of the projections clear the top of playing surface 54. The rotatable member may then be selectively rotated in a desired direction so that the game objects may be aligned with different apertures on playing surface 54. When a preselected position is reached, rotatable member 56 is permitted to be urged downwardly against playing surface 54.

The game apparatus of the present invention provides several distinct advantages in enabling a challenging and interesting game to be played. For instance, with reference to the embodiment shown in FIGS. 1–3, it can appreciated that the detachable tubes enable random orientation of the interconnection of the first and second arrays of apertures. With such a random orientation, it is nearly impossible for opposing players to calculate which aperture of the second array is interconnected with an aperture of the first array of the opposite playing surface. In addition, because the playing surfaces are directed to face in different directions, opposing players cannot view the opposite playing surface.

With respect to the second embodiment shown in FIGS. 4 and 5, it can be appreciated that the provision of an apertured rotatable member enables selective positioning and aligning of game objects thereon with apertures in a playing surface. Thus, it is possible for each opposing player to manipulate a rotatable member and vary object positioning. Depending upon the rules of a game, expulsion of an object may be worth so many points, etc., and thus it is important to provide some means by which the objects may be quickly and efficiently altered in their relationship to the playing surface. Thus, random orientations of the objects with apertures in the playing surface may be achieved which greatly adds to the complexity of a game.

While the invention has been particularly shown and described with reference to the foregoing preferred embodiments, it will be understood by those skilled in the art that other changes in form and detail may be made without departing from the spirit and scope of the invention as defined in the appended claims.

It is claimed and desired to secure for Letters Patent:

1. Game apparatus for use by opposing players comprising:

a housing having a pair of playing surfaces;

a first array of apertures provided on each playing surface;

a second array of apertures provided on each playing tubular means detachably interconnecting apertures of said first array on each playing surface with apertures of said second array on the other playing surface.

2. The game apparatus of claim 1 wherein said playing surfaces are positioned for facing in directions opposite to each other.

3. The game apparatus of claim 1 wherein said tubular means includes a plurality of fluid conducting tubes mounted within said housing.

4. The game apparatus of claim 1 wherein movable means are mounted above each first array of apertures, said movable means including apertures extending therethrough and operable for selectively aligning its apertures with apertures of an associated first array.

5. The game apparatus of claim 4 wherein said first array of apertures are arranged in concentric circular patterns, said movable means including a member rotatably mounted on its associated playing surface, said member having its apertures also arranged in concentric circular patterns.

* * * * *

UNITED STATES PATENT AND TRADEMARK OFFICE

CERTIFICATE OF CORRECTION

PATENT NO. : 4,150,830

DATED : April 24, 1979

INVENTOR(S) : Marshall E. Sink

It is certified that error appears in the above-identified patent and that said Letters Patent are hereby corrected as shown below:

In the claims:

Claim 1, column 4, line 45, after "playing" add --surface; and--.

Signed and Sealed this

*Twenty-second* Day of *July 1980*

[SEAL]

*Attest:*

SIDNEY A. DIAMOND

*Attesting Officer*

*Commissioner of Patents and Trademarks*